United States Patent [19]

Pursley

[11] Patent Number: 4,553,747

[45] Date of Patent: Nov. 19, 1985

[54] ROTATOR CUFF MACHINE

[76] Inventor: David A. Pursley, 599 Doyal Mills Ct., Stone Mountain, Ga. 30083

[21] Appl. No.: 493,171

[22] Filed: May 10, 1983

[51] Int. Cl.[4] ..... A63B 21/06

[52] U.S. Cl. ..... 272/118; 272/DIG. 4

[58] Field of Search ..... 272/118, 117, 130, 136, 272/134, 143, 67

[56] References Cited

U.S. PATENT DOCUMENTS

| | | | |
|---|---|---|---|
| 284,024 | 8/1883 | Kelly . | |
| 929,281 | 7/1909 | Brodeur | 272/67 X |
| 2,929,375 | 3/1960 | Spinks . | |
| 3,294,399 | 12/1966 | Cugliari | 272/67 X |
| 3,917,262 | 11/1975 | Salkeld | 272/118 |
| 3,921,975 | 11/1975 | Pridgen . | |
| 3,982,757 | 9/1976 | McDonnell | 272/136 X |
| 4,068,843 | 1/1978 | Frost | 272/67 X |
| 4,125,258 | 11/1978 | McArthur . | |
| 4,239,210 | 12/1980 | Lambert | 272/118 |
| 4,257,590 | 3/1981 | Sullivan et al. . | |
| 4,258,913 | 3/1981 | Brentham | 272/130 X |
| 4,333,644 | 6/1982 | Lambert, Jr. et al. . | |

*Primary Examiner*—Richard J. Apley
*Assistant Examiner*—William R. Browne
*Attorney, Agent, or Firm*—Schwartz, Jeffery, Schwaab, Mack, Blumenthal & Evans

[57] ABSTRACT

The disclosure describes a rotator cuff machine comprising an upright support frame having a front, a back and two sides. A handle is connected to a tensioning structure mounted on the upright support frame. The tensioning structure biases the handle such that the handle can be moved forwardly of the support frame under tension. A first body support member is spaced from the upright support frame and contains a first support surface positioned in front of the upright support frame. A second body support member is spaced from the upright support frame and contains a second support surface positioned in front of the upright support frame. The second support surface is spaced laterally of the first support surface and is also spaced vertically above the first support surface such that the arm of a user can rest substantially horizontally on the second body support surface while the user sits on the first body surface.

18 Claims, 5 Drawing Figures

ROTATOR CUFF MACHINE

BACKGROUND OF THE INVENTION

1. Field of the Invention

This invention relates to exercise machines, and more particularly to an exercise machine especially useful for athletes to strengthen and rehabilitate shoulder injuries and the muscles of the rotator cuff.

2. Discussion of Related Art

The rotator cuff or musculotendinous cuff consists of the fibers of the supraspinatus, infra-spinatus, teres minor, and subscapularis muscles, which blend with and reinforce the capsule of the shoulder joint. The rotator cuff is of importance because degeneration and subsequent tearing of its tendon of insertion is rather common pathology which results in restriction of shoulder movement, especially in abduction. It is important to keep these muscles strong and in good range of movement.

Many exercise machines are known. However, none of these known machines is specifically adapted to isolate and exercise the rotator cuff.

Some exercise machines can be used to exercise arm muscles in general. For example, U.S. Pat. No. 4,257,590 to Sullivan et al shows a portable home gymnasium which includes handle grips attached through cables to a weight. Movement of the handle grips moves the weight against gravity to exercise the arm muscles.

Other exercise devices are known which operate by movement of a weight or weights against the force of gravity. For example, U.S. Pat. No. 4,333,644 to Lambert, Jr., et al and U.S. Pat. No. 4,125,258 show exercise machines which include weights carried on a frame and guided by guide rods. The weights are attached through a cable to a grip or the like for pulling the weights along the guide rods.

Some exercise machines are adapted to isolate and exercise only a limited number of muscles of the body. For example, U.S. Pat. No. 3,921,975 to Pridgen shows a leg muscle exercise apparatus while U.S. Pat. No. 2,929,375 to Spinks shows a hand supinator.

U.S. Pat. No. 284,024 to Kelly shows a gymnastic chair comprising a rocking chair and a pair of adjustable arm supports attached to the seat of the rocking chair. Gymnastic exercises can be performed in the chair with the arms of the occupant supported at the sides of the chair.

SUMMARY OF THE INVENTION

One object of the present invention is to provide a machine for exercising the rotator cuff of a human being in which the muscles forming the rotator cuff can be isolated and exercised to improve their strength as well as range of movement.

Another object of the present invention is to provide a machine for exercising the rotator cuff of a human being which machine can be adjusted to suit the needs of a large number of individuals.

A further object of the present invention is to provide a machine for exercising the rotator cuff of a human being which machine is sufficiently versatile to permit the interchange of parts for individually exercising the rotator cuff of a person's right shoulder or the rotator cuff of a person's left shoulder.

An additional object of the present invention is to provide a machine for exercising the rotator cuff of a human being which machine is relatively simple in construction yet is durable and effective in use.

In accordance with the above and other objects, the present invention is a machine for exercising the rotator cuff of a human being, comprising an upright support frame having a front, a back and two sides, a handle, and a tensioning mechanism mounted on the upright support frame for biasing the handle such that the handle can be moved forwardly of the support frame against tension. A first body support member is spaced from the upright support frame and contains a first body support surface positioned in front of the upright support frame. A second body support member is spaced from the upright support frame and contains a second body support surface positioned in front of the upright support frame. The second body support surface is spaced laterally of the first body support surface and is also spaced vertically above the first body support surface such that the arm of a user can rest on the second body support surface while the user sits on the first body support surface.

In accordance with other aspects of the invention, the second body support surface comprises two upwardly diverging portions for cradling the arm of a user and the first body support surface comprises a generally planar portion which forms a seat for the user.

The invention may also include a mechanism for adjusting the vertical height of the first body support surface and a mechanism for adjusting the vertical height of the second body support surface.

In accordance with further aspects of the invention, the tensioning mechanism comprises a cable connected to the handle, a weight connected to the cable, and a pulley connected to the upright support frame. The cable extends over the pulley such that when the handle is pulled, the weight rises to permit the handle to be moved only against the force of gravity on the weight. The mass of the weight can be adjusted to accommodate varying degrees of resistance.

According to other aspects of the invention, a mounting structure is included for removably supporting the first body support member and a second mounting structure is included for removably supporting the second body support member such that the first and second body support members can be completely removed in the event that the user is to operate the machine while standing in an upright position. Furthermore, the first and second mounting structures are interchangeable such that the positions of the first and second body support members can be reversed to individually exercise either the right shoulder rotator cuff or the left shoulder rotator cuff.

The present invention also includes a method of exercising the rotator cuff of a human subject using a machine having a seat, an arm support surface spaced vertically and horizontally from the seat, and a handle mounted on a frame and movable against tension. The handle is initially spaced from a plane formed by the seat and arm support surface and is movable against tension in the general direction of the plane of the seat and arm support surface. The method comprises positioning the subject on the seat generally facing such that the rotator cuff to be exercised points toward the arm support surface. The upper arm of the subject attached to the rotator cuff to be exercised is then supported on the arm support surface and the hand of that arm grasps the handle. The lower portion of the same arm is then rotated against the tension on the handle.

In accordance with other aspects of the invention, the subject is positioned facing toward the frame mounting the handle and the step of rotating comprises rotating the lower arm from a position generally horizontal against tension to a position generally vertical.

In accordance with further aspects of the invention, the step of positioning the subject comprises facing the subject away from the frame mounting the handle and the step of rotating comprises rotating the lower arm from a position generally vertical to a position generally horizontal against the tension on the handle.

BRIEF DESCRIPTION OF THE DRAWINGS

The above and other objects of the present invention will become more readily apparent as the invention becomes more clearly understood in connection with the detailed description to follow, reference being had to the accompanying drawings in which like reference numerals represent like parts throughout, and in which.

DETAILED DESCRIPTION OF THE PREFERRED EMBODIMENT

Figure 3:
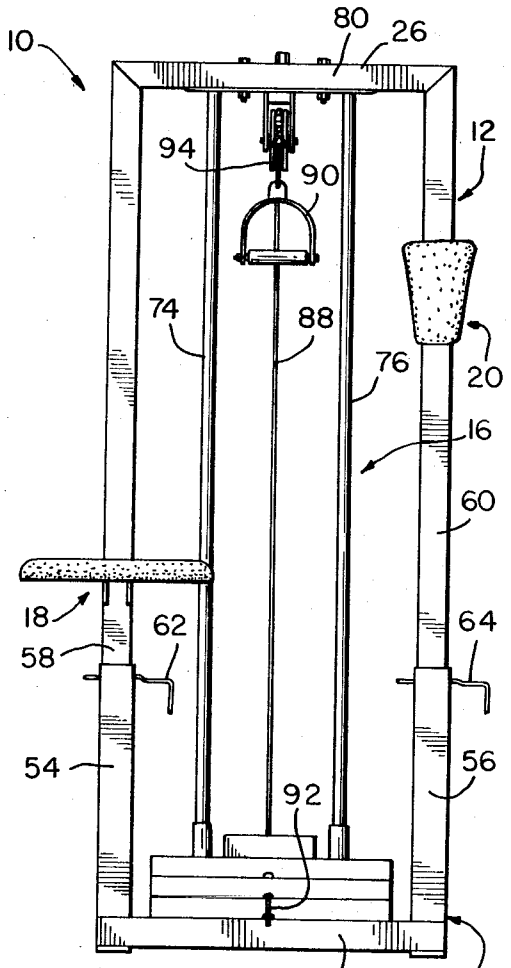
FIG. 3 is a front elevational view of the exercise machine of the present invention.
Figure 2:
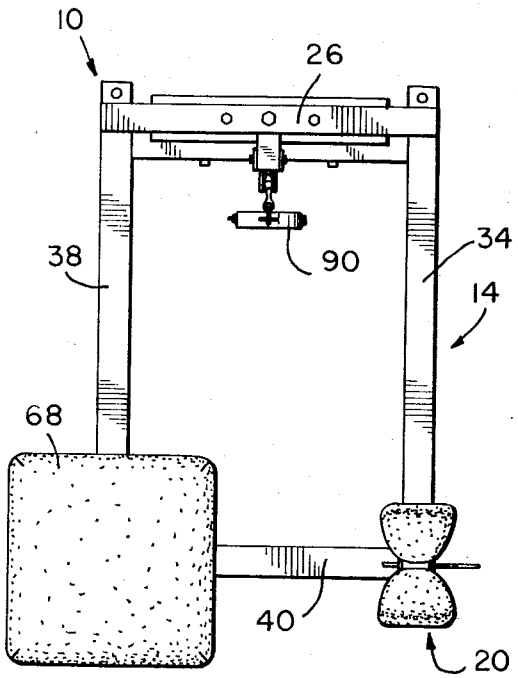
FIG. 2 is a top plan view of the exercise machine of the present invention.
Figure 1:
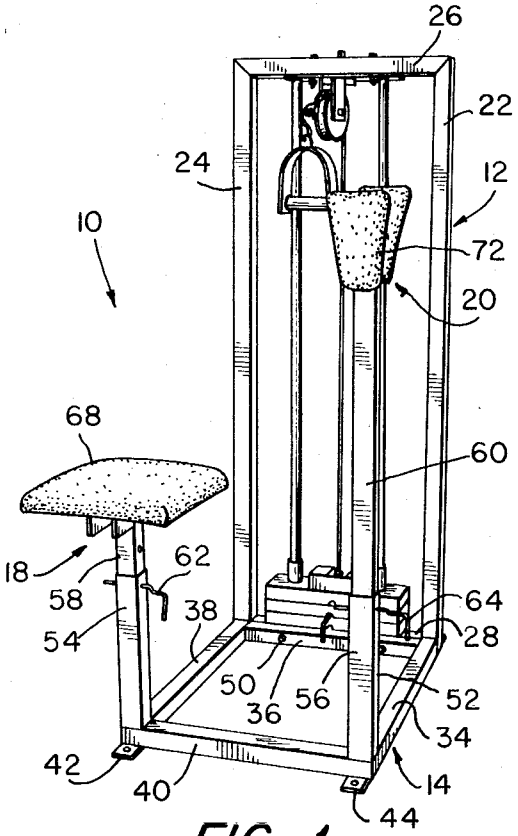
FIG. 1 is a perspective view of the exercise machine of the present invention.
Figure 5:
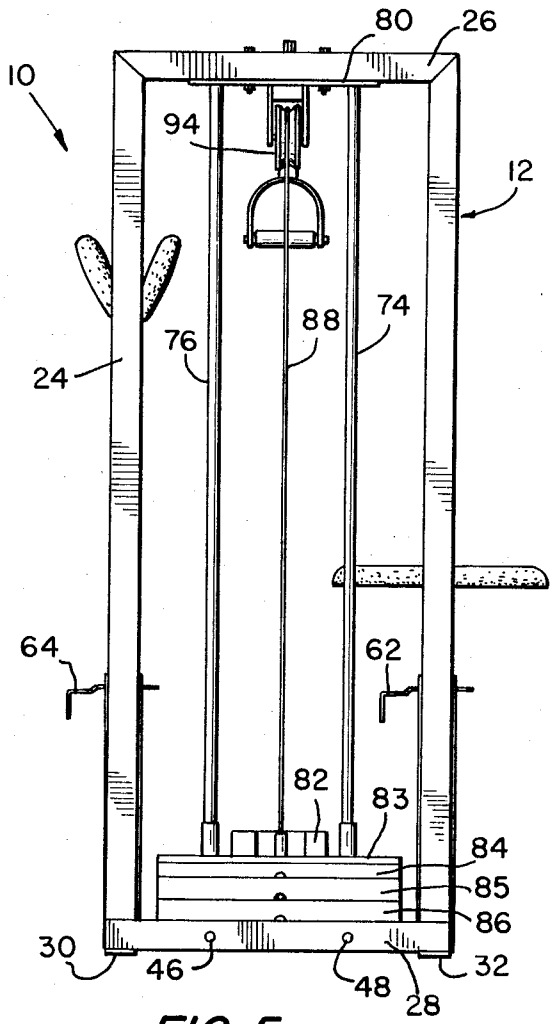
FIG. 5 is a rear elevational view of the exercise machine of the present invention.
Figure 4:
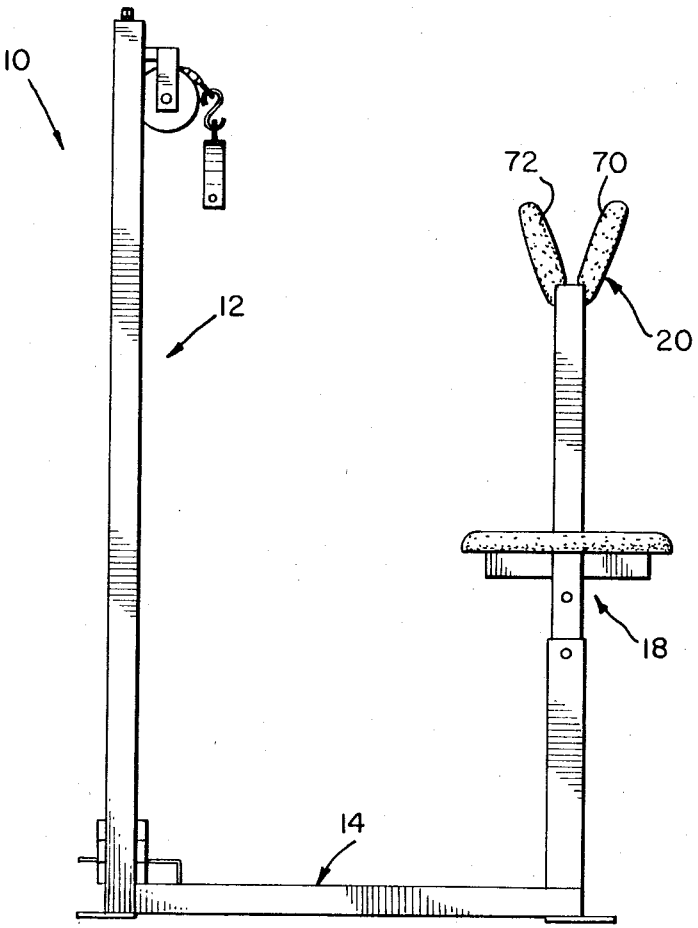
FIG. 4 is a side elevational view of the exercise machine of the present invention.

With reference to FIGS. 1–5, it will be seen that the rotator cuff machine 10 comprises a generally upright support frame 12 which is attached to a horizontal lower frame 14. Frame 12 mounts a tension mechanism 16 while frame 14 mounts two body support elements 18 and 20.

Frame 12 comprises two vertical frame members 22 and 24 which are connected to horizontal top and bottom frame members 26 and 28 to form a rigid rectangular frame. Each of the frame members may be rectangular metal tubing and the frame can be welded together at its four corners. A pair of mounting plates 30 and 32 are attached to bottom frame member 28 for securing the frame 12 to the floor of an exercise room, gym or the like. Preferably, bolt holes (not shown) are formed in plates 30 and 32 for this purpose.

Horizontal frame 14 is also rectangular and comprises four rectangular tubular members 34, 36, 38 and 40 which are welded or otherwise connected at their ends to form the rectangular shape. A pair of mounting plates 42 and 44 are attached to frame member 40 and contain bolt holes for easy attachment to the floor of an exercise room or the like. Frame 14 can be connected to frame 12 in any suitable manner. However, according to the invention, this connection is preferably made by bolts 46 and 48 which pass through frame members 28 and 36 and attach to nuts 50 and 52. In this manner, the frames can easily be separated for movement of the machine 10, if necessary.

Member 40 of horizontal frame 14 is also welded or otherwise attached to two upright rectangular tubular members 54 and 56 which are spaced from the front of frame 12 by an equal distance. Members 54 and 56 are hollow and slidably receive rectangular shafts 58 and 60 of the body support members 18 and 20, respectively. It should be noted that shafts 58 and 60 are slightly smaller than members 54 and 56 so they can easily slide up and down therein. Also, shafts 58 and 60 are equal in size so that they can be interchanged whereby the positions of support members 18 and 20 can be reversed from the positions shown in the drawings. It should also be noted that with pins 62 and 64 removed, support members 18 and 20 can be removed entirely to permit exercises to be done which do not require those support members. Tubular members 54 and 56 should be sufficiently short so as not to interfere with the performance of exercises when members 18 and 20 are removed. For this reason, tubular members 54 and 56 could be approximately one foot high.

In order to adjust the height of body support members 18 and 20, a series of aligned holes are formed in each of the shafts 58 and 60. The holes in the shafts can be aligned with a pair of holes formed in each member 54 and 56. A pin 62 is provided to slide through aligned openings in member 54 and shaft 58. Likewise, a pin 64 slides through aligned openings in member 56 and shaft 60. Obviously, to adjust the height of each body support member 18, 20, the appropriate pin 62, 64 is removed and a different set of openings in the associated shaft 58, 60 is aligned with the pin openings in the associated member 54, 56.

Body support member 18 includes a generally planar support surface 68 which can be in the form of a padded seat, as shown, for the user to sit on. Support member 20 comprises a support surface having a pair of upwardly diverging portions 70 and 72 which cradle the upper arm of the user in the area just above the elbow. These support surfaces 70 and 72 can also be padded, as shown.

The tensioning mechanism 16 comprises a pair of guide rails 74 and 76 which are positioned parallel to each other and extend between the upper and lower horizontal frame members 26 and 28 of upright frame 12. Guide rails 74 and 76 can be attached in any convenient manner. As shown, they are connected to an upper plate 80 which is bolted to the upper frame member 26. A similar plate can be bolted to the lower frame member 28 in a similar manner. A plurality of weights 82 through 86 can be connected to slide on guide rails 74 and 76. Weight 83 is fixedly attached to a cable 88 and contains a connector (not shown) which extends down through openings formed in weights 84–86. Weight 82 is a free weight which rests on the top of weight 83. The number of weights attached to the connector on weight 83 at any particular time is determined by the position of a pin 92 which slides through an opening formed in the weights 84–86 in a well known manner. Accordingly, the total mass of the weight attached to cable 88 can be adjusted by changing the position of pin 92, or by adding or removing free weights such as weight 83.

Cable 88 extends over a pulley 94 which is rotatably mounted to upper horizontal frame member 26 and is attached to a handle 90. Accordingly, by pulling on handle 90, cable 88 is drawn over pulley 94 and the weights attached to cable 88 are drawn upwardly along guide members 74, 76. The total number of weights to be used can vary, as desired. However, in practice, it has been found that a total weight of 35 pounds is desirable. This weight is divided among the five members as follows: a top weight 83 of 2½ pounds is attached to cable 88, a loose weight 82 of 2½ pounds is available, and the remaining three weights 84–86 are 10 pounds each.

In practice, machine 10 can be used for producing external rotation in adduction, internal rotation in adduction, external rotation in abduction, and internal rotation in abduction.

For external and internal rotation in adduction, pins 62 and 64 are removed and body support members 18 and 20 are separated from the device leaving essentially only frame member 12 and tensioning mechanism 16.

For external rotation in adduction, the user stands in front of the machine with the shoulder to be exercised pointing away from the frame 12 and the non-exercising shoulder pointing toward the frame 12. Frame 12 is approximately three to five feet high so that handle 90 is conveniently located at approximately waist height. The user takes hold of handle 90 with the hand of the arm to be exercised and the elbow of that arm is held next to the user's side and kept there throughout the exercise. Now, with the wrist against the user's stomach, the user rotates the lower arm away from the body as far as possible and resists the weight with the shoulder on the return trip to the stomach. This motion is repeated 10 times and three sets of 10 are completed.

For internal rotation in adduction, the stance is reversed so that the shoulder to be exercised is closest to the upright frame 12 and the non-exercising shoulder points away from the frame 12. The pulley is held in the hand of the arm attached to the shoulder to be exercised and the elbow is kept next to the user's side. Keeping the elbow in position against that side, the user moves the lower arm across the body against resistance and touches the stomach. The weights are then lowered going back to the starting position. This exercise is repeated 10 times.

For external rotation in abduction, the seat and arm rest are placed on the machine with the arm rest placed on the same side of the machine as the shoulder to be exercised when the user faces the upright frame 12. The user then sits down facing the frame 12 and places the elbow of the arm to be exercised in arm support 20 and adjusts the seat height such that the upper part of the arm is substantially horizontal or forms approximately a 90° angle with the body. The pulley is then held in the hand of the supported arm and, with the arm bent 90° at the elbow, the arm is moved in external rotation away from frame 12 from a position substantially horizontal to a position which is slightly beyond the vertical position. The arm is then moved to the starting position and this movement is repeated 10 times with as much weight as possible.

For internal rotation in abduction, seat 18 and arm rest 20 are reversed so that the arm rest 20 is on the side of the machine as the non-exercising arm when the user faces upright frame 12. The user then sits facing away from upright member 12 and the elbow of the arm to be exercised is supported in arm rest 20. The seat is adjusted so that the upper portion of the supported arm makes a 90° angle to the user's body. The pulley handle is held in the hand of the supported arm and starting with the lower portion of the supported arm in a position slightly beyond vertical, the arm is rotated away from frame 12 into a substantially horizontal position and the returned to the starting position. This movement is repeated 10 times.

The foregoing description was given for the purpose of illustrating the present invention but is not deemed to limit the scope thereof. Clearly, numerous additions and modifications could be made to the present invention without departing from the scope thereof, as set forth in the appended claims.

What is claimed is:

1. A machine for exercising the rotator cuff of a human being, comprising:

an upright support frame having a front, a back and two sides;

a handle;

tension means mounted on said upright support frame for biasing said handle said handle being movable forwardly of said support frame under tension;

a first body support member comprising a set spaced from said upright support frame and containing a first body support surface positioned in front of said upright support frame;

a second body support member comprising an arm rest spaced from said upright support frame and containing a second body support surface positioned in front of said upright support frame, said second body support surface being spaced vertically above said first body support surface such that the arm of a user can rest in a substantially horizontal position on said second body support surface while the user sits on said first body support surface, said seat and said arm rest being positioned in a plane which passes through the shoulders of a user such that the users arm is positioned substantially in said plane to isolate the rotator cuff for exercising.

2. A machine as set forth in claim 1, wherein said second body support surface has two upwardly diverging portions for cradling the arm of a user.

3. A machine as set forth in claim 1, wherein said first body support surface comprises a generally planar portion which forms a seat for the user.

4. A machine as set forth in claim 1 including means for adjusting the vertical height of said first body support surface.

5. A machine as set forth in claim 1 including means for adjusting the vertical height of said second body support surface.

6. A machine as set forth in claim 1, wherein said tension means comprises a cable connected to said handle, a weight connected to said cable, and a pulley connected to said upright support frame, said cable extending over said pulley such that when said handle is pulled, said weight rises up to permit said handle to be moved only against the force of gravity on said weight.

7. A machine as set forth in claim 6, wherein said tension means further includes at least one guide rod connected to said upright support frame and being received in an opening in said weight for guiding said weight vertically.

8. A machine as set forth in claim 6 including means for changing the mass of said weight.

9. A machine as set forth in claim 1, wherein said handle is positioned between said first body support surface and said second body support surface.

10. A machine as set forth in claim 1 including means for removably supporting said first body support member in front of said upright support frame such that said first body support member can be removed, and including means for removably supporting said second body support member in front of said upright support frame such that said second body support member can be removed.

11. A machine as set forth in claim 1, wherein said handle is initially positioned above said first body support member.

12. A machine as set forth in claim 1, wherein said first body support surface and said second body support surface are positioned at approximately the same distance in front of said upright support frame.

13. A machine as set forth in claim 1, wherein said upright support frame is generally rectangular.

14. A machine as set forth in claim 1 including a generally rectangular horizontal frame attached to said upright support frame, said first and second body support members being supported on said horizontal frame.

15. A machine for exercising the rotator cuff of a human being, comprising:

an upright support frame having a front, a back and two sides;

a handle;

tension means mounted on said upright support frame for biasing said handle such that said handle can be moved forwardly of said support frame while under tension;

a first body support member spaced from said upright support frame and containing a first body support surface positioned in front of said upright support frame;

a second body support member spaced from said upright support frame and containing a second body support surface positioned in front of said upright support frame, said second body support surface being spaced vertically above said first body support surface such that the arm of a user can rest in a substantially horizontal position on said second body support surface while the user sits on said first body suppport surface;

means for removably supporting said first body support member in front of said upright support frame such that said first body support member can be removed;

means for removably supporting said second body support member in front of said upright support frame such that said second body support member can be removed, wherein said means for supporting said first body support member and said means for supporting said second body support member are interchangeable so that the positions of said first and second body support members can be changed in order that opposite rotator cuffs may be exercised.

16. A method of using an exercise machine having a seat, an arm support surface spaced vertically and horizontally from said seat, and a handle mounted on a frame and movable against tension, said method including the steps of:

the user positioning his self on said seat generally facing the machine so that the rotator cuff to be exercised;

extending laterally the upper arm of the subject connected to the rotator cuff to be exercised so that the upper arm may rest on the arm support surface in a generally horizontal disposition;

grasping said handle with the hand of the supported arm;

rotating the lower part of said arm against the resistive force acting on said handle.

17. The method as set forth in claim 16, wherein the step of positioning said subject comprises facing the subject toward said frame mounting said handle and the step of rotating comprises rotating said lower arm from a position generally longitudinal against tension to a position generally vertical.

18. The method as set forth in claim 16, wherein the step of positioning comprises facing the subject away from said frame mounting said handle and the step of rotating comprises rotating said lower arm from a position generally vertical to a position generally horiztonal against the tension on the handle.

* * * * *